US006772753B2

(12) United States Patent
Roesler et al.

(10) Patent No.: US 6,772,753 B2
(45) Date of Patent: Aug. 10, 2004

(54) ADJUSTABLE ORIFICE PLATE FOR EXHAUST DUCTS

(75) Inventors: Bruce Roesler, Wixom, MI (US); Adrien de Borchgrave, Canton, MI (US); Clifton Sprinkles, South Lyon, MI (US); Lawrence A. Cook, Commerce Township, MI (US)

(73) Assignee: Durr Industries, Inc., Plymouth, MI (US)

( * ) Notice: Subject to any disclaimer, the term of this patent is extended or adjusted under 35 U.S.C. 154(b) by 5 days.

(21) Appl. No.: 10/212,434

(22) Filed: Aug. 5, 2002

(65) Prior Publication Data

US 2004/0020485 A1 Feb. 5, 2004

(51) Int. Cl.[7] ..... F24C 1/14
(52) U.S. Cl. ..... 126/80; 126/312; 126/292
(58) Field of Search ..... 431/12, 19, 20; 126/80, 285 R, 285 A, 286, 292, 293, 312

(56) References Cited

U.S. PATENT DOCUMENTS 60,453 A * 11/1866 Wilson
4,201,186 A * 5/1980 Paquin ..... 126/83
4,251,025 A * 2/1981 Bonne et al. ..... 236/14
5,993,195 A * 11/1999 Thompson ..... 431/19

* cited by examiner

*Primary Examiner*—Henry Bennett
(74) *Attorney, Agent, or Firm*—Howard & Howard

(57) ABSTRACT

An exhaust duct orifice adjustment device for a gas-fired heater used to indirectly heat an oven communicating with a heat exchanger, wherein the exhaust duct includes a fixed annular orifice plate and a switch having a pressure sensor on opposed sides of the fixed orifice plate, turning off the burner if the pressure drop falls below a predetermined minimum. The orifice adjustment mechanism includes a moveable plate upstream of the fixed orifice plate having an opening communicating with the opening in the fixed orifice plate and an adjustment mechanism moving the orifice adjustment plate from a retracted position, wherein the opening through the fixed orifice plate is substantially unobstructed, to an extended position which restricts the opening through the fixed orifice plate, thereby adjusting the pressure drop.

18 Claims, 2 Drawing Sheets

ADJUSTABLE ORIFICE PLATE FOR EXHAUST DUCTS

FIELD OF THE INVENTION

The present invention relates to a static pressure adjustment device for an exhaust duct receiving heated gas from a gas-fired burner or the like through a heat exchanger, wherein the burner must be turned off when the gas flow rate falls below a predetermined minimum.

BACKGROUND OF THE INVENTION

Gas-fired burners or heaters are conventionally used to heat or dry components or assemblies in an oven or chamber in industrial applications. In many such applications, the oven or heating chamber includes a combustible gas. For example, a paint drying oven such as used by the automotive industry may include volatile organic compounds (vocs), such as solvents, which are highly combustible. In such applications, the heated gas from the burner is directed to a heat exchanger which indirectly heats the oven or heated chamber and the heated gas is then vented through an exhaust duct. It is essential, however, that the gas-fired burner be turned off in the event that the gas flow volume from the heat exchanger through the exhaust duct falls below a predetermined minimum rate or volume to avoid a hazardous condition.

In this type of application, the exhaust duct from the heat exchanger generally includes a fixed orifice plate having a central opening. A switch having pressure sensors on opposed sides of the fixed orifice plate then turns the gas-fired burner off in the event that the gas flow through the exhaust duct falls below a predetermined minimum volume. As will be understood, the sensors of the safety switch measure the fluid pressure drop across the fixed orifice plate. The National Fire Protection Association (NFPA) Code requires that the burner be shut off in the event that duct gas (air) is not flowing through the exhaust to prevent a hazardous condition.

The principal problem with such fixed orifice plates in an application of the type described occurs during start up. For example, the minimum pressure drop required across a conventional fixed orifice plate may be 0.2 inches of water. This exact condition is difficult to reach, particularly during start up prior to balancing the system. It would therefore be desirable to be able to adjust the opening through the fixed orifice plate particularly during start up of the oven. Once the opening through the fixed orifice plate is adjusted, generally no further adjustment will be required following installation.

The problems associated with startup of a modern paint drying oven, for example, are compounded by the fact that an automotive paint drying oven may have 8 to 20 heat zones ranging in temperature from about 300° F. to 600° F. Each zone of the oven includes a gas fired burner which directs heated gas to a heat exchanger which indirectly heats the zone. It is not possible to simply calculate the pressure drop required to actuate the switch shutting off the burner for each zone because the density of the air circulated through the oven decreases as the temperature increases. Therefore, it is conventional to start up the oven and heat each of the zones to the required temperature and measure the pressure drop across the fixed orifice plate using the switch. Then, the fixed orifice plates are replaced as required with orifice plates having a greater or smaller opening. This is a time consuming task. There is therefore a need for a simple method of adjusting the opening through the orifice plate which may be maintained after start up.

SUMMARY OF THE INVENTION

As set forth above, the present invention relates to a static pressure adjustment device particularly, but not exclusively, for adjusting the opening through a fixed orifice plate in an exhaust duct communicating with a gas-fired burner through a heat exchanger providing indirect heat to a drying oven or heated chamber containing combustible gas.

As described, the exhaust duct receiving heated gas from a gas-fired burner or the like includes a fixed annular orifice plate extending generally perpendicular to the direction of gas flow having a periphery fixed to an inside surface of the duct and a central opening for maintaining a predetermined minimum fluid pressure drop at a predetermined gas flow rate through the exhaust duct. In a typical application, the exhaust duct is cylindrical and welded at the seam making it difficult to adjust the opening or orifice through the fixed annular orifice plate. A switch mechanism is provided having a pressure sensor on opposed sides of the fixed annular orifice plate which turns the burner off when the pressure drop across the fixed orifice plate drops below a predetermined minimum.

The exhaust duct system of this invention further includes a moveable orifice adjustment plate mounted adjacent the fixed orifice plate at an upstream side of the fixed annular orifice plate having an opening generally aligned with the opening through the fixed annular orifice plate and the exhaust duct system further includes an adjustment mechanism connected to the moveable orifice adjustment plate for moving the moveable orifice adjustment plate relative to the fixed orifice plate from a retracted position, wherein the opening of the moveable orifice adjustment plate is generally aligned with the opening through the fixed annular orifice plate, to an extended position restricting the opening through the fixed annular orifice plate to adjust the effective opening through the fixed and moveable orifice plates thereby adjusting the pressure drop across the orifice plates.

In the preferred embodiment, wherein the exhaust duct is cylindrical as described, the opening through the fixed annular orifice plate is circular and the opening of the moveable orifice plate is generally semicircular. In the most preferred embodiment, the moveable orifice adjustment plate is generally C-shaped including a generally semicircular opening having a radius generally equal to the radius of the opening through the fixed annular orifice plate, such that when the moveable orifice adjustment plate is in the retracted position, the opening through the fixed annular plate is not restricted by the moveable orifice adjustment plate. Further, in the preferred embodiment, the adjustment mechanism includes an adjustment element or rod connected to the moveable orifice adjustment plate and extending through the exhaust duct to permit adjustment of the position of the moveable orifice adjustment plate from outside the duct.

In the disclosed embodiment, the adjustment device includes a rod connected to the mid-portion of the C-shaped moveable orifice adjustment plate, such as by welding, which extends through the wall of the exhaust duct and including an externally threaded portion which is threadably received in an internally threaded members used as jam nuts to lock the moveable orifice adjustment plate in the desired location. The position of the moveable orifice adjustment plate relative to the fixed annular orifice plate may then be adjusted simply by releasing the jam nuts and moving the rod.

The static pressure adjustment device for an exhaust duct of this invention therefore solves the problem of adjusting the orifice through a fixed orifice plate in a simple and reliable manner. Other advantages and meritorious features of this invention will be more fully understood from the following description of the preferred embodiments, the appended claims and the drawings, a brief description of which follows.

DETAILED DESCRIPTION OF THE PREFERRED EMBODIMENTS

Figure 1:
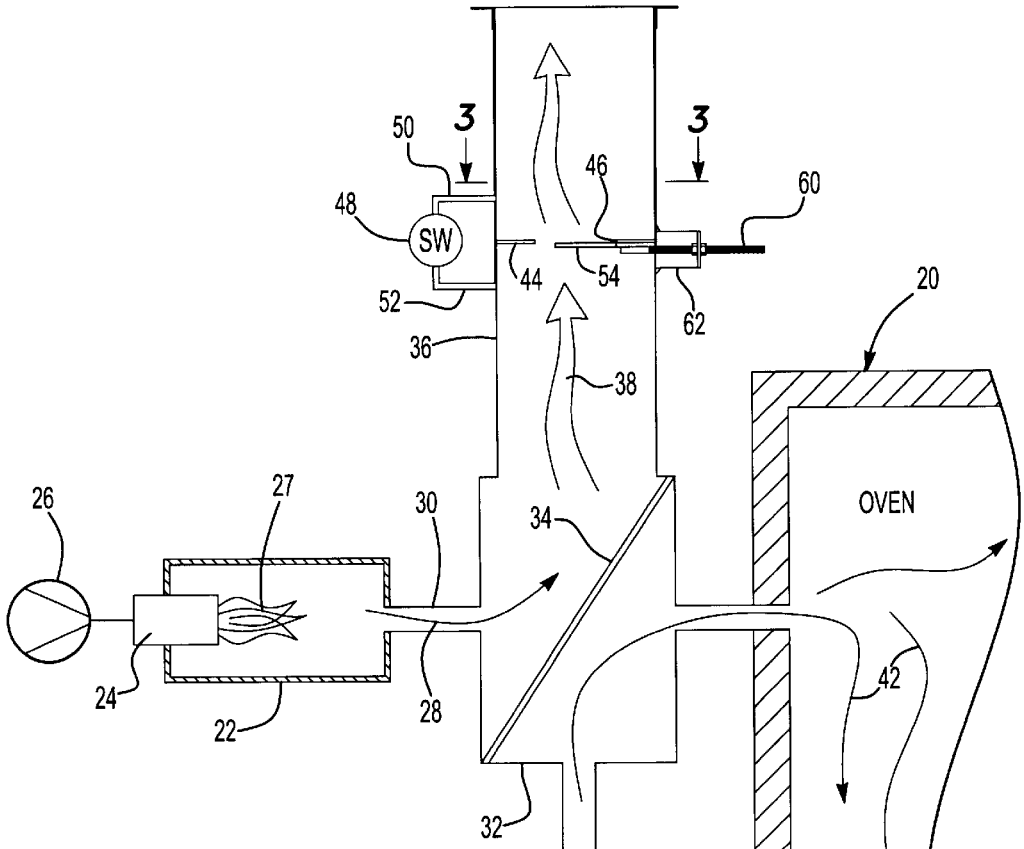
FIG. 1 is a partially cross-sectioned, partially schematic side view of a heater assembly for an oven illustrating the environment of this invention.

As set forth above, the static pressure adjustment device for an exhaust duct of this invention may be utilized with an oven shown schematically in FIG. 1 at 20 or a heating or drying chamber, such as a paint drying oven containing vocs or other combustible gases. The oven 20 is indirectly heated by a heater 22, such as a conventional gas-fired burner 24 connected to a source of a combustible gas 26 creating a flame 27 in the heater 22. The heated gas shown by arrow 28 is circulated through an inlet 30 to a heat exchanger 32, shown schematically, including a baffle 34 which separates the heat exchanger 32 into at least two compartments. The heated gas from the burner 24 is then received from the heat exchanger 32 into an exhaust duct 36 as shown by arrow 38. Air or other gas is circulated from the oven 22 as shown by arrow 38 to the heat exchanger 32 through one or a plurality of recirculating ducts 40 and the heated air is then circulated from the heat exchanger 32 to the oven 20 as shown by arrows 42. The oven 20 or other heated chamber 20 is thus heated indirectly by the gas-fired burner 24 such that combustible gas in the oven 20 is not exposed to the gas-fired burner 24, thereby avoiding combustion of the combustible gas such as vocs in a paint drying oven 20. However, as set forth above, the NFPA Code requires that the burner 24 be turned off in the event that the gas flow through the exhaust duct 36, as shown by arrow 38, ceases to flow to avoid a hazardous condition. As set forth above, FIG. 1 actually illustrates one zone of a conventional paint drying oven wherein the oven may have 8 to 20 heat zones each including an indirect heating system as shown in FIG. 1.

Figure 3:
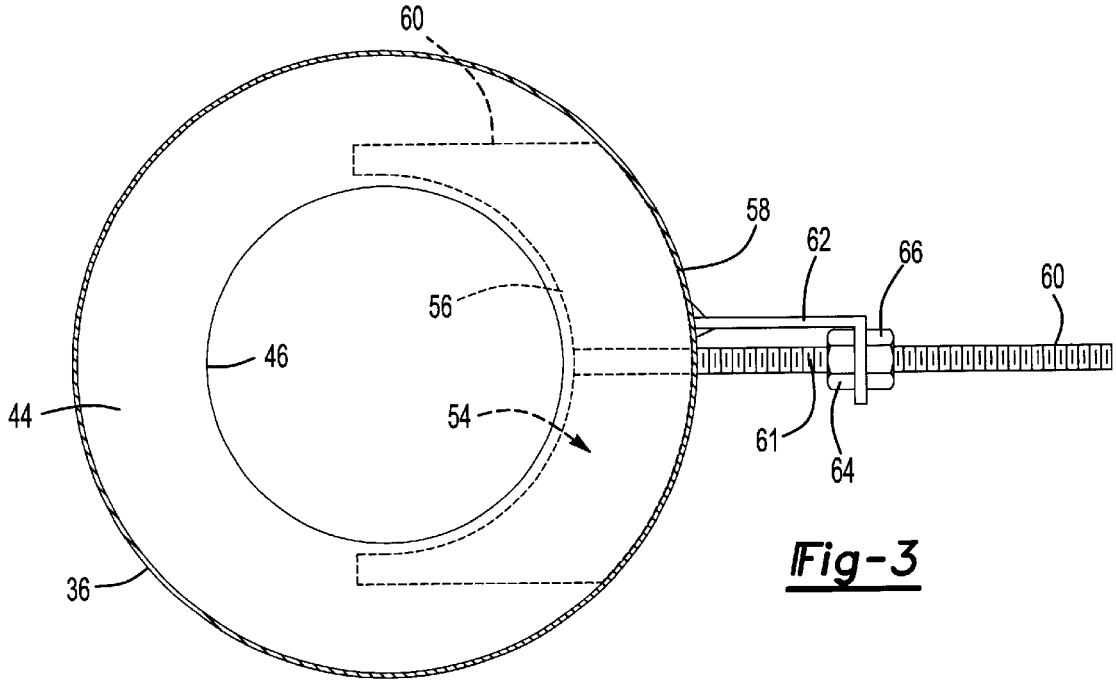
FIG. 3 is a top cross-sectional view of FIG. 1 in the direction of view arrows 3—3 with the moveable orifice adjustment plate in the retracted position.
Figure 4:
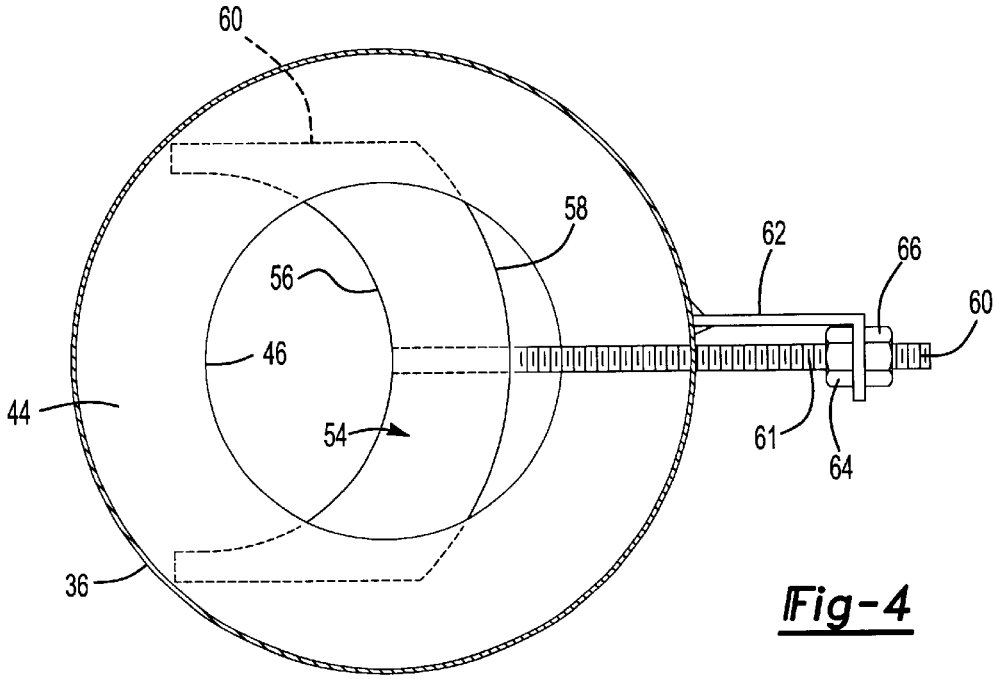
FIG. 4 is a top cross-sectional view of FIG. 3 with the moveable orifice adjustment plate in the extended position.

The gas flow through the exhaust duct 36 shown by arrow 38 is "monitored" by the pressure drop across a fixed annular orifice plate 44, also shown in FIGS. 3 and 4, including an opening 46 having an internal diameter smaller than the internal diameter of the exhaust duct 36 as shown in FIGS. 3 and 4. As also shown in FIGS. 3 and 4, the exhaust duct 36 is continuous or welded to avoid leakage of the exhaust duct and, in the disclosed embodiment, the exhaust duct is cylindrical wherein the periphery of the fixed annular orifice plate 44 is circular and welded or otherwise secured within the exhaust duct 36 in sealed relation. As shown in FIG. 1, the flow of heated gas 38 through the exhaust duct 36 is measured or monitored by a pressure sensitive switch 48 having pressure sensor lines or tubes 50 and 52 on opposed sides of the fixed annular orifice plate 44. As will be understood by those skilled in this art, the switch 48 thus measures the pressure drop across the fixed annular orifice plate 44 and the switch then turns off the burner 24 when the pressure drop or flow of heated gas falls below a predetermined minimum, thereby preventing continued operation of the gas-fired burner and a potentially hazardous situation.

As set forth above, however, the opening 46 through the fixed annular orifice plate 44 cannot be adjusted following assembly. This is a particular problem during start up for proving air flow through the exhaust duct 36. This problem is presently solved by removing the fixed orifice plate and replacement with a plate having a larger or smaller internal diameter opening. The orifice adjustment device of this invention solves this problem and eliminates the requirement for replacing the fixed orifice plate 44, as now described.

Figure 2:
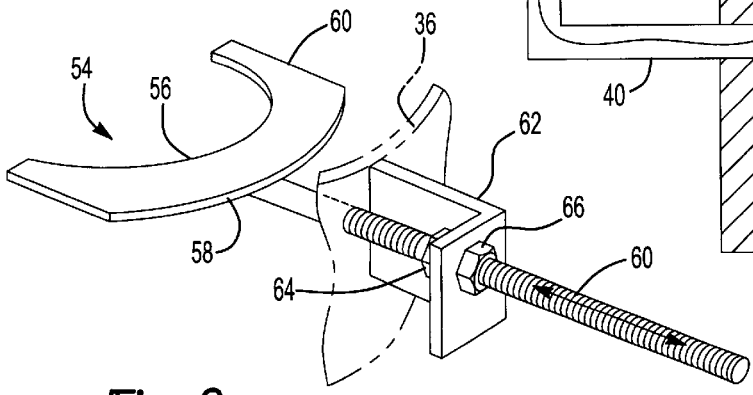
FIG. 2 is a side elevation illustrating a preferred embodiment of the moveable orifice adjustment plate of this invention illustrated in FIG. 1.

The exhaust duct system of this invention includes a moveable orifice adjustment plate 54 shown in FIGS. 2 to 4. As shown, the preferred embodiment of the moveable orifice adjustment plate 54 is generally C-shaped having an opening 56 at its leading edge which, in the preferred embodiment, is semicircular and coincident with the internal opening 46 of the fixed annular orifice plate 44 when the moveable orifice adjustment plate 54 is in the retracted position as shown in FIG. 3. Thus, in the retracted position, the moveable orifice adjustment plate 54 does not restrict the flow through the fixed orifice plate 44 as shown in FIG. 3. Further, in the preferred embodiment of the invention, the trailing surface 58 of the moveable orifice adjustment plate 54 is also circular or semicircular, as best shown in FIG. 4, to conform to the cylindrical shape of the exhaust duct 36. The sides 60 are most preferably linear to permit further extension of the moveable orifice adjustment plate 54 as shown in FIG. 4. The moveable orifice adjustment plate 54 is also preferably located upstream of the fixed orifice adjustment plate 44 as shown in FIG. 1 such that the fixed orifice plate supports the moveable orifice plate under the pressure of the gas flow through the duct.

FIGS. 3 and 4 best illustrate a suitable adjustment mechanism for adjusting the position of the moveable orifice adjustment plate 54. In the disclosed embodiment, the adjustment mechanism includes a rod 60, preferably a cylindrical rod having external threads 61, L-shaped bracket 62 including an opening (not shown) which receives the rod therethrough and at least one nut 64, preferably two nuts 64 and 66 for adjustment of the rod 60 and thereby adjustment of the moveable orifice adjustment plate 54. In the preferred embodiment, the adjustment mechanism includes two jam nuts 64 and 66, wherein both of the nuts 64 and 66 are threadably received on the threaded portion 61 of the rod 60, one on each side of the bracket 62. The rod 60 may be welded or otherwise attached to the moveable orifice adjustment plate 54 and the L-shaped bracket 62 may be welded to the exhaust duct 36, as shown. The position of the moveable orifice adjustment plate 54 is then adjusted by loosening one or both of the nuts 64 and 66 moving the rod 60 to the desired location.

As will be understood by those skilled in this art, a typical oven used to cure paint by the automotive industry may include 8 to 20 gas-fired burners heating different zones of the oven, wherein each zone may have a different temperature requirement depending upon several conditions, including the vehicles being conveyed through the oven, the velocity or speed of the conveyor, the paint being used and the type of vehicle. During start up, the temperature circulating through the oven is ambient or "cold." The air is then heated in each of the zones by a gas-fired burner 24 as shown in FIG. 1. The temperature in the various zones may range from 300° F. to 600° F. depending upon the requirements set forth above. However, it is not possible to calculate the appropriate pressure drop across the fixed orifice plate 44 prior to heating the zones to the required temperatures. Therefore, in a typical start up, the zones of the oven are heated to the desired temperature for the particular application by the gas burner 24 shown in FIG. 1. As will be understood, the density of the air circulated through the heat exchanger 32 from the oven 20 decreases as the temperature increases. When the desired temperature in the several zones of the oven has been achieved, the pressure drop across the fixed orifice plate 44 is "measured" by the switch 48. Prior to this invention, it was then necessary to remove and replace the fixed orifice plates with orifice plates having a smaller or larger opening until the pressure drop across each orifice plate was about one inch of water at the desired temperature of the oven zone. This is obviously a time-consuming effort. Further, it may be necessary to adjust the orifice plates after start up in the event that the conditions of the oven are materially changed.

However, with the moveable orifice adjustment plate 54 and the adjustment mechanism disclosed in FIGS. 3 and 4, the effective opening through the fixed orifice plate 44 may be easily and accurately adjusted simply by the rotating nuts 64 and 66, which extends or retracts the moveable orifice adjustment plate 54. The moveable orifice plate may be adjusted from the retracted position shown in FIG. 3 to the extended position shown in FIG. 4. The second nut 66 may then be used to lock the moveable orifice adjustment plate 54 in the desired location.

Having described a preferred embodiment of this invention, it will be understood by those skilled in the art that various modifications may be made with in the purview of the appended claims. For example, various adjustment mechanisms may be used to extend or retract the moveable orifice adjustment plate. Further, the shape of the moveable orifice adjustment plate will depend upon the shape of the fixed orifice plate.

What is claimed is:

1. An oven heater for heating an oven containing volatile organic compounds, comprising: a gas-fired burner communicating with a heat exchanger receiving air from said oven and circulating heated air to said oven, said heat exchanger including an exhaust duct, a fixed annular orifice plate within said exhaust duct including an opening therethrough maintaining a predetermined minimum fluid pressure drop at a predetermined gas flow rate through said exhaust duct, a moveable orifice adjustment plate mounted adjacent said fixed annular orifice plate at an upstream side of said fixed annular orifice plate having an opening aligned with said opening through said fixed annular orifice plate, and an adjustment mechanism connected to said moveable orifice adjustment plate for moving said moveable orifice plate relative to said fixed orifice plate from a retracted position, wherein said opening of said moveable orifice adjustment plate is generally aligned with said opening through said fixed annular orifice plate, to an extended position restricting said opening through said fixed annular orifice plate to adjust an effective opening through said fixed and moveable orifice plates, thereby adjusting said pressure drop.

2. The oven heater as defined in claim 1, wherein said opening through said fixed annular orifice plate is generally circular and said opening of said moveable orifice plate is generally semicircular.

3. The oven heater as defined in claim 1, wherein said exhaust duct includes a switch mechanism having a pressure sensor on opposed sides of said fixed annular orifice plate, wherein said switch mechanism turns off said burner when said pressure drop falls below a predetermined minimum.

4. The oven heater as defined in claim 1, wherein said exhaust duct is circular and said fixed annular orifice plate has a circular periphery fixed to an internal surface of said exhaust duct and said moveable orifice adjustment plate is generally C-shaped.

5. The oven heater as defined in claim 4, wherein said opening of said C-shaped moveable orifice adjustment plate has a radius generally equal to an internal radius of said opening through said fixed annular orifice plate, such that when said moveable orifice adjustment plate is in said retracted position, said opening through said fixed annular orifice plate is not restricted by said moveable orifice adjustment plate.

6. The oven heater as defined in claim 4, wherein said adjustment mechanism includes an adjustment element extending through said exhaust duct.

7. The oven heater as defined in claim 6, wherein said adjustment element includes a rod connected to a mid-portion of said C-shaped moveable orifice adjustment plate and extending through said exhaust duct.

8. The oven heater as defined in claim 7, wherein said rod is externally threaded and said adjustment mechanism includes an internally threaded member fixed relative to said exhaust duct threadably receiving said rod.

9. An oven heater for heating an oven containing volatile organic compounds, comprising: a burner communicating with a heat exchanger receiving air from said oven and circulating heated air to said oven, said heat exchanger having an exhaust duct including a fixed annular orifice plate within said exhaust duct having an opening therethrough, maintaining a predetermined minimum fluid pressure drop at a predetermined gas flow through said exhaust duct, a generally C-shaped moveable orifice adjustment plate mounted adjacent said fixed annular orifice plate at an upstream side of said fixed annular orifice plate generally perpendicular to an axis of said opening through said fixed orifice plate having an opening generally aligned with said opening through said fixed annular orifice plate, an adjustment mechanism connected to said moveable orifice adjustment plate for moving said moveable orifice adjustment plate relative to said fixed annular orifice plate from a retracted position, wherein said opening of said moveable orifice adjustment plate is generally aligned with said opening through said fixed annular orifice plate, to an extended position restricting said opening through said fixed annular orifice plate to adjust an effective opening through said fixed and moveable orifice plates, and a pressure switch mechanism including a pressure sensor on opposed sides of said fixed annular orifice plate turning off said burner when said pressure drop falls below a predetermined minimum.

10. The oven heater as defined in claim 9, wherein said opening through said fixed annular orifice plate is generally circular and said opening of said C-shaped moveable orifice adjustment plate is generally semicircular having a radius generally equal to said opening through said fixed annular orifice plate, such that when said C-shaped moveable orifice adjustment plate is in said retracted position, said opening through said fixed annular orifice plate is not restricted by said moveable orifice adjustment plate.

11. The oven heater as defined in claim 9, wherein said adjustment mechanism includes an adjustment element extending through said exhaust duct permitting adjustment of the position of said moveable orifice adjustment plate relative to said fixed annular orifice plate from outside said exhaust duct.

12. The oven heater as defined in claim 9, wherein said adjustment mechanism includes a rod connected to a mid-portion of said C-shaped moveable orifice adjustment plate extending through said exhaust duct.

13. The oven heater system as defined in claim 12, wherein said rod is externally threaded and said adjustment mechanism includes an internally threaded element fixed relative to said exhaust duct threadably receiving said rod.

14. An exhaust duct system communicating with a heater receiving heated gas comprising an exhaust duct, a fixed annular orifice plate within said exhaust duct including an opening therethrough maintaining a predetermined minimum fluid pressure drop at a predetermined gas flow rate through said exhaust duct, a generally C-shaped moveable orifice adjustment plate mounted adjacent said fixed annular orifice plate at an upstream side of said fixed annular orifice plate having an opening generally equal to and aligned with said opening through said fixed annular orifice plate, and an adjustment mechanism having an externally threaded rod and an internally threaded member threadably receiving said rod fixed relative to said exhaust duct connected to a mid-portion of said moveable orifice adjustment plate for moving said moveable orifice plate relative to said fixed annular adjustment plate from a retracted position, wherein said opening of said moveable orifice adjustment plate is generally aligned with said opening through said fixed annular orifice plate, to an extended position restricting said opening through said fixed annular orifice plate to adjust an effective opening through said fixed and moveable orifice plates, thereby adjusting said pressure drop.

15. The exhaust duct system as defined in claim 14, wherein said opening through said fixed annular orifice plate is generally circular and said opening of said moveable orifice plate is generally semicircular.

16. The exhaust duct system as defined in claim 14, wherein said exhaust duct system includes a pressure switch mechanism having a pressure sensor on opposed sides of said fixed annular orifice plate and a switch mechanism turning off said burner when said pressure drop falls below a predetermined minimum.

17. The exhaust duct system as defined in claim 14, wherein said opening of said moveable orifice adjustment plate has a radius generally equal to said opening through said fixed annular orifice plate, such that when said moveable orifice adjustment plate is in said retracted position, said opening through said fixed annular orifice plate is not restricted by said moveable orifice adjustment plate.

18. A method of balancing the air flow in an oven having a plurality of zones, each zone having a different temperature, each zone including a gas-fired heater directing heated air through a heat exchanger to an exhaust duct including a fixed annular orifice plate having an opening therethrough creating a pressure drop through said opening and a switch including a sensor line on opposed sides of said fixed annular orifice plate adapted to turn off the gas-fired burner in the event that the pressure drop falls below a predetermined minimum and wherein air is circulated from said oven through said heat exchangers, thereby heating said oven, said method comprising the following steps:

operating said gas-fired burners in each of said zones to achieve the desired temperature in each of said zones; and moving an adjustable orifice plate to partially close said opening through said fixed annular orifice plate to obtain a desired pressure drop across said fixed annular orifice plate.

* * * * *

UNITED STATES PATENT AND TRADEMARK OFFICE

CERTIFICATE OF CORRECTION

PATENT NO. : 6,772,753 B2
DATED : August 10, 2004
INVENTOR(S) : Bruce Roesler et al.

It is certified that error appears in the above-identified patent and that said Letters Patent is hereby corrected as shown below:

Column 5,
Line 57, please insert the word -- annular -- after the word "fixed."

Signed and Sealed this

Twenty-sixth Day of October, 2004

JON W. DUDAS
*Director of the United States Patent and Trademark Office*